United States Patent [19]

Kronfeld

[11] Patent Number: 4,572,362

[45] Date of Patent: Feb. 25, 1986

[54] LIGHT BULB PACKAGE

[76] Inventor: Marcie Kronfeld, 1989 NE. 119 Road, North Miami, Fla. 33181

[21] Appl. No.: 630,718

[22] Filed: Jul. 13, 1984

[51] Int. Cl.[4] ..... B65D 85/42

[52] U.S. Cl. ..... 206/45.14; 206/418; 206/521; 229/22

[58] Field of Search ..... 206/45.14, 45.19, 418–422, 206/521; 229/39 B, 22; 248/152

[56] References Cited

U.S. PATENT DOCUMENTS

| | | | |
|---|---|---|---|
| 1,681,287 | 8/1928 | French | 229/39 B |
| 1,932,705 | 10/1933 | Menten | 229/39 B |
| 1,996,778 | 4/1935 | Wellman | 229/39 B |
| 2,682,949 | 7/1954 | Whitehead | 229/39 B |
| 3,279,677 | 10/1966 | Wojcik | 206/521 |
| 3,515,864 | 6/1970 | Levy et al. | 206/418 |
| 4,131,198 | 12/1978 | Fischer | 229/39 B |
| 4,391,371 | 7/1983 | Sieffert | 206/419 |

FOREIGN PATENT DOCUMENTS

| | | | |
|---|---|---|---|
| 0289243 | 4/1928 | United Kingdom | 229/39 B |
| 0337261 | 10/1930 | United Kingdom | 229/39 B |

*Primary Examiner*—William T. Dixson, Jr.
*Assistant Examiner*—Jimmy G. Foster
*Attorney, Agent, or Firm*—John Cyril Malloy

[57] ABSTRACT

A one-piece light bulb package for protectively shipping and displaying glass light bulbs, the package fabricated from a one-piece pre-cut blank including two foldable center panels positioned in side-by-side juxaposition along a center fold line of weakness. The two center panels preferably have identical generally rectangular peripheral shapes, each center panel having a generally triangular panel adjacent either end. One triangular panel at diagonally opposing ends of the two rectangular center panels has a hole therethrough, one hole sized to supportably receive the smaller threaded metal end of the light bulb, the other hole sized to supportably receive at least a portion of the larger glass bulbous end of the light bulb. Each apertured triangular panel is spaced apart from the corresponding end of the rectangular center panel and connected thereto by a generally rectangular positioning panel. Along at least a portion of the correspondingly opposing edges of each triangular panel is a glue tab. All panels are separated one from another by crease or fold lines of weakness for ease of assembly. The blank is made from a single die or pre-cut relatively rigid, yet flexible, paperboard sheet. Glue tabs may be pre-glued or glue coated on assembly of the package around a bulb. The package may include indicia of bulb size. The package is generally a polyhedron having generally triangular top and bottom and rectangular vertical sides. Two sides are formed from the center panels, the third side being open for light bulb display therein.

7 Claims, 4 Drawing Figures

LIGHT BULB PACKAGE

BACKGROUND OF THE INVENTION

The present invention relates generally to protective packaging for light bulbs, and more particularly, to a one-piece protective display packaging for various size light bulbs.

In the past, light bulb manufacturers have used various disposable means for shipping and/or displaying light bulbs. This packaging has been a compromise between cost of manufacture and assembly, the degree of protection for the light bulb(s), and/or commercial effectiveness of the display.

U.S. Pat. No. 3,857,481 discloses a one-piece package particularly adapted for light bulbs having pointed ends. Another one-piece carton for incandescent electric globes is shown in U.S. Pat. No. 3,568,913, but which is less protective as at least a portion of the globe is in contact with the outer, wrapped panel. A more complex two-piece carton is disclosed in U.S. Pat. No. 3,407,921, which avoids bulb contact with the outer panels, but which is more expensive to manufacture and assemble around a light bulb.

Another short coming of at least some of said prior art is to allow an unscrupulous consumer to easily switch a larger for a smaller bulb between price-marked packages, paying a lower price for the larger bulb.

Other inventions for displaying and/or packaging other fragile glass articles are disclosed in U.S. Pat. Nos. 4,018,335; 4,099,612; and 2,015,222.

The present invention, however, provides a one-piece structure made from a blank or pre-cut sheet of relatively rigid, yet flexible, paperboard or the like which is inexpensive to manufacture and assemble around a light bulb while providing both maximum protection and a unique display shape which virtually prevents bulb size switching.

BRIEF SUMMARY OF THE INVENTION

This invention is for a light bulb package fabricated from a single pre-cut sheet for protectively packaging, shipping, and uniquely displaying glass light bulbs. The pre-cut sheet includes two center panels, preferably having identical outer rectangular peripheral shapes, and positioned in side-by-side juxaposition, along a center fold line therebetween. Each center panel includes a generally triangular panel adjacent both ends. Two of the four triangular panels, diagonally opposing, have a hole therethrough, one hole sized to supportively receive the smaller threaded metal end of a light bulb, the other hole sized to supportively receive at least a portion of the larger glass bulbous end of the light bub.

Each apertured triangular panel is spaced apart from the adjacent corresponding end of the rectangular center panel and connected thereto by a generally rectangular positioning panel.

Along at least a portion of the correspondingly opposing edges of each triangular panel is a glue tab. All panels are separated by creases or fold lines of weakness to facilitate assembly of a light bulb therein.

The package is made from a single die or pre-cut relatively rigid, yet flexible, preferably paper or cardboard sheet. The four glue tabs retain the package shape as the pre-cut sheet is folded and assembled around a light bulb.

It is therefore an object of this invention to provide a one-piece package for protecting and displaying a light bulb.

It is another object to provide the above invention having a novel display shape.

It is yet another object to provide the above invention as an inexpensive and easy to manufacture and assemble light bulb packaging means.

Still another object of the above invention is to provide improved damage protection for fragile glass bulbs during shipping and retail display.

And another object of the above invention is to reduce the opportunity for a consumer to switch light bulbs and packages.

In accordance with these and other objects which will become apparent hereinafter, the instant invention will now be described with reference to the accompanying drawings in which:

DETAILED DESCRIPTION OF THE PREFERRED EMBODIMENT

Figure 1:
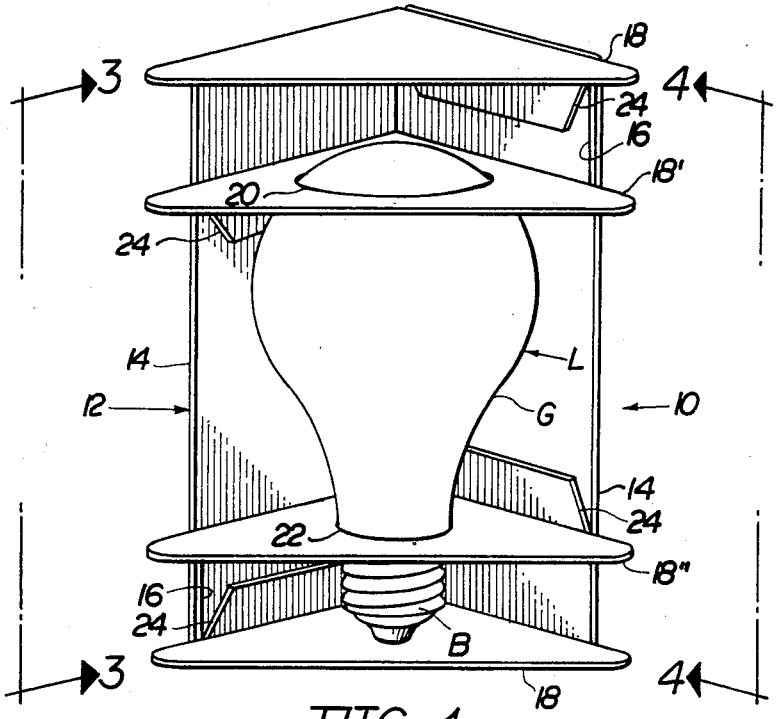
FIG. 1 is a perspective view of the invention having a light bulb housed therein.

Referring now to the drawings, and particularly to FIG. 1, the claimed invention is shown generally at 10. The basic form is as shown, a polyhedron, having a generally triangular top 18 and bottom 18 and two generally rectangular vertical center panels 14, the third side being open. In the preferred embodiment, two additional generally horizontal intermediate triangular panels 18' and 18'' are included, having the same shape as that of the top and bottom triangular panels 18. However, these intermediate triangular panels 18' and 18'' include apertures 20 and 22 respectively therethrough. Aperture 22 is adapted to threadably receive the light bulb metal base B, while aperture 20 is sized to receive at least a portion of the end of the larger glass portion G of the light bult L.

By these apertures 20 and 22, and the sizing of the four triangular panels 18, 18', and 18'', and rectangular center panels 14, a light bulb L housed as shown and described will be free of any contact between the glass G and any outer panel. Additionally, the light bulb L is highly visable for display within this unique package shape.

To further protect the glass G, the free edge of each triangular panel 18, 18' and 18'' are preferably extended or continued outwardly beyond the plane formed by the free vertical edges of the two center panels 14. These triangular panel extensions, rounded at the two exposed corners as shown, provide light bulb protection from even the dropping of said package to floor or ground. Any minor impact against a relatively flat surface will not damage the glass G.

Figure 3:
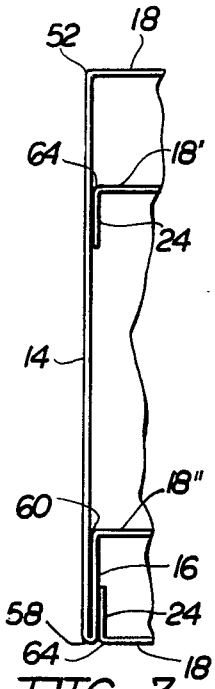
FIG. 3 is a broken elevation view of the invention in the direction of arrows 3—3 in FIG. 1.
Figure 2:
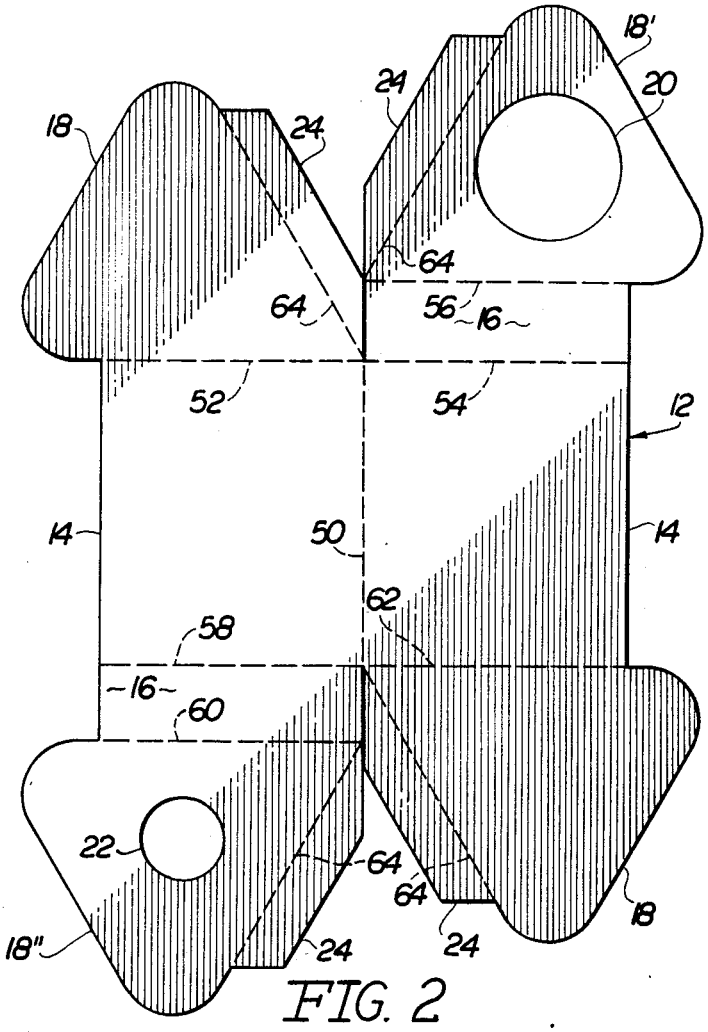
FIG. 2 is a plan view of the one-piece blank used to fabricate the invention.
Figure 4:
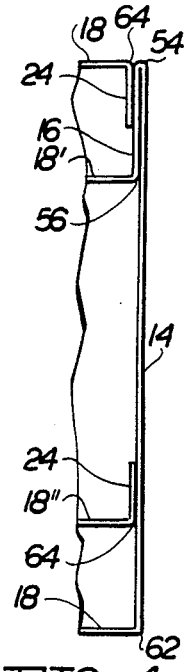
FIG. 4 is a broken elevation view of the invention in the direction of arrows 4—4 in FIG. 1.

Referring now also to FIGS. 2, 3 and 4, a one-piece blank or pre-cut sheet 12 is used to construct the package 10. In FIG. 2, fold lines of weakness are depicted generally by dash lines, while cut edges are shown as solid lines. The two rectangular center panels 14 are arranged in side-by-side arrangement, separated by fold line 50. Adjacent opposing ends of different center panels 14 are the top and bottom triangular panels 18, separated from the ends of the center panel 14 by fold lines 52 and 62. Adjacent the two other opposing ends of different center panels 14 are two rectangular positioning panels 16, separated from the end of the center panel 14 by fold lines 54 and 58. The respective ends of the two positioning panels 16 and free sides of the two center panels 14 have common margins as shown. Adjacent the outer sides of the two positioning panels 16 are the two apertured triangular panels 18' and 18'', separated by fold lines 56 and 60. Four glue tabs 24 are each positioned along one edge of each triangular panel, each separated by fold line 64. These glue tabs may be preglued or glue-coated at assembly of the package 10 as discussed below.

To assemble the blank 12 into a light bulb package 10, protectively housing a light bulb L therein, folds are first made along fold lines 50, 58, and 62. The fold at 58 is a complete doubling over of positioning panel 16 glued against the center panel 14 as best seen in FIG. 3. The triangular panel 18'' is then positioned generally perpendicular the center panel 14 by folding along fold line 60. Glue tabs 24 are also folded perpendicular to the adjacent triangular panels 18 and 18'' along fold line 64. Thereafter, glue tabs 24 are adhered to positioning panel 16 best shown in FIG. 3 and to center panel 14 in FIG. 4 to secure the two lower triangular panels 18 and 18''.

After the metal light bulb base B is received into aperture 22, the upper triangular panels 18 and 18' may, similarly to the above, be folded and glued into place. After folding along fold lines 52, 54 and also folding the remaining glue tabs 24 along fold line 64 adjacent triangular panels 18 and 18', positioning panel 16 is doubled over and glued against center panel 14 as shown in FIG. 4. Glue tab 24 of triangular panel 18' is also secured to the center panel 14 as best seen in FIG. 3. The aperture 20 has now been securely positioned around a top portion of glass G. Thereafter, the top triangular panel 18 with its glue tab 24 folded along fold line 64 may then be secured in place by adhering glue tab to the positioning panel 16 as shown in FIG. 4.

The blank 12 may be cut from sheet paperboard or the like, so long as the material selected is relatively rigid, yet flexible, and cost efficient. The blank 12 may, in addition to having markings thereon to identify the manufacture or the like, may also include indicia of bulb size.

Although four triangular panels 18, 18' and 18'' are preferred, either or both top and bottom triangular panels 18 may optionally be deleted to further reduce cost while maintaining a certain high degree of protection for the light bulb house therein.

While the instant invention has been shown and described herein in what is conceived to be the most practical and preferred embodiment, it is recognized that departures may be made therefrom within the scope of the invention, which is therefore not to be limited to the details disclosed herein but is to be accorded the full scope of the claims so as to embrace any nd all equivalent apparatus and articles.

What is claimed is:

1. A package for protectively displaying a light bulb and like article therein, said package comprising:

(a) a one-piece precut sheet of relatively rigid yet flexible material including two center panels each being substantially equivalently dimensioned and having a rectangular configuration, said two center panels being foldably attached along a weakened fold line integrally secured to commonly disposed longitudinal edges of each center panel, (b) said sheet further comprising four substantially triangular panels including a first two triangular panels each foldably connected directly to an oppositely disposed longitudinal end of different ones of said center panels, and a second two triangular panels each movably interconnected to an oppositely disposed longitudinal end of different ones of said center panels, (c) a positioning panel foldably attached to each of said two second triangular panels and to said respective longitudinal ends of said center panel and disposed to interconnect and properly position said respective second triangular panels and said center panel to one another, (d) each of said second triangular panels being apertured to accommodate passage therethrough of a portion of the light bulb being displayed, (e) each of said four triangular panels including a mounting tab foldably connected to a substantially commonly positioned perpendicular edge thereof, said mounting tab cooperatively positioned and structured relative to said four triangular panels and said center panels so as to dispose said four triangular panels in a substantially parallel, spaced apart relation to one another when said package is assembled, (f) said assembled package defined by a first and a second peripheral edge of each triangular panel transversely disposed in engagement with different ones of said center panels said first and said second peripheral edge being dimensioned to extend beyond said respective center panels, (g) a third peripheral edge of each of said triangular panels being disposed outwardly from said center panels and beyond a plane defined by the outermost longitudinal edges of each center panel, (h) said package further structured to include, when assembled, an open face for display of the light bulb, said open face defined by said outwardly disposed third peripheral edge of said triangular panels and said outermost longitudinal edges of said center panels being unattached to a remainder of said package.

2. A package as in claim 1 wherein said open face comprises an open space between each pair of adjacently positioned triangular panels, said open space of each respective pair defined by said outwardly extending third peripheral edges and a portion of said respective first and second peripheral edges, of each pair, extending beyond said two center panels.

3. A package as in claim 1 wherein each of the third peripheral edges of said triangular panels are disposed in coplanar relation to one another.

4. A package as in claim 3 wherein said first two triangular panels define the top and bottom of said assembled package and are located at opposite extremities of said assembled package.

5. A package as in claim 4 wherein said second pair of triangular panels are positioned to engage substantially opposite ends of the light bulb being displayed and are positioned in adjacent, spaced apart relation to a respectively disposed panel of said first triangular panels.

6. A light bulb display package as set forth in claim 1, wherein:

said polyhedron is sized to prevent contact of the glass portion of the light bulb with the inside surfaces of said polyhedron.

7. A light bulb display package as set forth in claim 1, wherein:

said sheet is paperboard.

* * * * *